US008342623B2

(12) United States Patent
Hong et al.

(10) Patent No.: US 8,342,623 B2
(45) Date of Patent: Jan. 1, 2013

(54) METHODS OF ADJUSTING INK EJECTION CHARACTERISTICS OF INKJET PRINTING APPARATUS AND DRIVING THE INKJET PRINTING APPARATUS

(75) Inventors: Young-ki Hong, Anyang-si (KR); Jae-woo Chung, Yongin-si (KR); Joong-hyuk Kim, Seoul (KR)

(73) Assignee: Samsung Electronics Co., Ltd., Gyeonggi-Do (KR)

( * ) Notice: Subject to any disclaimer, the term of this patent is extended or adjusted under 35 U.S.C. 154(b) by 170 days.

(21) Appl. No.: 12/801,591

(22) Filed: Jun. 16, 2010

(65) Prior Publication Data

US 2011/0134175 A1 Jun. 9, 2011

(30) Foreign Application Priority Data

Dec. 9, 2009 (KR) ..... 10-2009-0121944

(51) Int. Cl.
*B41J 29/38* (2006.01)

(52) U.S. Cl. ..... 347/10

(58) Field of Classification Search ..... 347/9–11, 347/19, 68

See application file for complete search history.

(56) References Cited

U.S. PATENT DOCUMENTS

| | | | | |
|---|---|---|---|---|
| 6,431,675 | B1 * | 8/2002 | Chang | 347/10 |
| 6,799,821 | B1 * | 10/2004 | Okuda | 347/10 |
| 7,223,309 | B2 * | 5/2007 | Takahashi et al. | 118/712 |

FOREIGN PATENT DOCUMENTS

| | | |
|---|---|---|
| JP | 2008-119844 | 5/2008 |
| KR | 10-2006-0038439 | 5/2006 |
| KR | 10-2007-0078206 | 7/2007 |
| KR | 10-2008-0050319 | 6/2008 |

* cited by examiner

*Primary Examiner* — An Do

(74) *Attorney, Agent, or Firm* — Harness, Dickey & Pierce, P.L.C.

(57) ABSTRACT

Methods of adjusting ink ejection characteristics of an inkjet printing apparatus and driving the inkjet printing apparatus are provided. A method of adjusting ink ejection characteristics of an inkjet printing apparatus may include adjusting at least one of a voltage and an application duration of a driving signal applied to a plurality of piezoelectric actuators that provide ejection pressures to a plurality of nozzles so that volumes of a plurality of ink droplets ejected from the plurality of nozzles are uniform, and displacing an application starting time of the driving signal applied to the plurality of piezoelectric actuators so that the plurality of ink droplets ejected from the plurality of nozzles reach a printing medium at a same time.

11 Claims, 9 Drawing Sheets

METHODS OF ADJUSTING INK EJECTION CHARACTERISTICS OF INKJET PRINTING APPARATUS AND DRIVING THE INKJET PRINTING APPARATUS

CROSS-REFERENCE TO RELATED APPLICATIONS

This application claims priority under 35 U.S.C. §119 to Korean Patent Application No. 10-2009-0121944, filed on Dec. 9, 2009, in the Korean Intellectual Property Office (KIPO), the disclosure of which is incorporated herein in its entirety by reference.

BACKGROUND

1. Field

Example embodiments relate to methods of adjusting ink ejection characteristics of an inkjet printing apparatus, in which sizes and positions of ink droplets ejected onto a printing medium may be uniformly adjusted, and methods of driving the inkjet printing apparatus.

2. Description of the Related Art

Inkjet printing apparatuses print images on a surface of a sheet of printing paper by ejecting minute droplets of printing ink on a printing medium, for example, on a desired portion of the sheet of printing paper by using an inkjet printhead. Inkjet printing apparatuses have recently come into widespread use in various fields such as flat panel display devices such as liquid crystal displays (LCDs) and organic light emitting devices (OLEDs), flexible display devices such as electronic paper (E-paper), printed electronics such as metal wiring, and organic thin film transistors (OTFTs).

SUMMARY

Provided are methods of adjusting ink ejection characteristics of an inkjet printing apparatus, for ejecting ink droplets onto substantially exact positions and methods of driving the inkjet printing apparatus.

Additional aspects will be set forth in part in the description which follows and, in part, will be apparent from the description, or may be learned by practice of example embodiments.

In accordance with example embodiments, a method of adjusting ink ejection characteristics of an inkjet printing apparatus may include adjusting at least one of a voltage and an application duration of a driving signal applied to a plurality of piezoelectric actuators that provide ejection pressures to a plurality of nozzles so that volumes of a plurality of ink droplets ejected from the plurality of nozzles are uniform, and displacing an application starting time of the driving signal applied to the plurality of piezoelectric actuators so that the plurality of ink droplets ejected from the plurality of nozzles reach a printing medium at a same time.

In accordance with example embodiments, a method of driving an inkjet printing apparatus may include applying a first driving signal to a plurality of piezoelectric actuators to eject a first plurality of ink droplets onto a printing medium from a plurality of nozzles, determining a plurality of second driving signals for the plurality of piezoelectric actuators by adjusting at least one of a voltage and an application duration of the first driving signal so that volumes of a second plurality of ink droplets having a uniform volume are ejected from the plurality of nozzles, and displacing application starting times of the plurality of second driving signals and applying the second driving signals with the displaced application starting time to the plurality of piezoelectric actuators so that the second plurality of ink droplets ejected from the plurality of nozzles reach a printing medium at the same time.

According to example embodiments, a method of adjusting ink ejection characteristics of an inkjet printing apparatus may include adjusting at least one of a voltage and an application duration of a driving signal with respect to a plurality of piezoelectric actuators that provide ejection pressure to a plurality of nozzles so that volumes of a plurality of ink droplets ejected from the plurality of nozzles are uniform. In accordance with example embodiments, the method may further include displacing an application starting time of the driving signal with respect to the plurality of piezoelectric actuators so that the plurality of ink droplets ejected from the plurality of nozzles reach a printing medium at the same time.

In example embodiments, adjusting the at least one of a voltage and the application duration of the driving signal may include ejecting a plurality of ink droplets by applying first driving signals having the same waveform to the plurality of piezoelectric actuators, respectively, detecting volumes of the plurality of ejected ink droplets after a reference time period corresponding to a reference position, and determining a second driving signal by adjusting at least one of a voltage and an application duration of the first driving signals such that the detected volumes of the ink droplets are the same with respect to the plurality of piezoelectric actuators.

In example embodiments, displacing the application starting time of the driving signal may include ejecting a plurality of ink droplets by respectively applying a plurality of the second driving signals to the plurality of piezoelectric actuators at the same time, determining movement distances of the plurality of ink droplets after the reference time period, and determining a displacement amount S of the application starting time as $S=T\times(A/F-1)$, where the movement distances of the plurality of ink droplets are F, a distance from the reference position to the plurality of nozzles is A, and the reference time period is T.

The reference position may include a location where the printing medium is disposed.

When applying the first and second driving signals, an electrostatic voltage that applies an electrostatic force to ink in the plurality of nozzles may be applied.

In example embodiments, displacing of the application starting time of the driving signal may include ejecting a plurality of ink droplets onto the printing medium that is being moved by applying the second driving signals to the plurality of piezoelectric actuators, determining an offset amount with respect to the plurality of ink droplets from the reference position, and determining a displacement amount S of the application starting time as $S=Fb/Vm$, where the offset amount is Fb, and a movement speed of the printing medium is Vm.

In example embodiments, displacing of the application starting time of the driving signal may include ejecting a plurality of ink droplets on the printing medium that is being moved, by applying the second driving signals to the plurality of piezoelectric actuators, determining, based on one of the plurality of ink droplets, offset amounts of the other ink droplets, and determining a displacement amount S of the application starting time as $S=Fb/Vm$, where the offset amount is Fb, and a movement speed of the printing medium is Vm.

According to example embodiments, a method of driving an inkjet printing apparatus may include determining a driving signal, wherein at least one of a voltage and an application duration of the driving signal is adjusted with respect to a plurality of piezoelectric actuators, so that volumes of a plurality of ink droplets ejected from a plurality of nozzles are the same, and displacing an application starting time of the determined driving signal with respect to the plurality of piezoelectric actuators and applying the driving signal with the displaced application starting time to the plurality of piezoelectric actuators so that the plurality of ink droplets ejected from the plurality of nozzles reach a printing medium at the same time.

An electrostatic voltage that applies an electrostatic force to ink in the plurality of nozzles may be applied together with the determined driving signal.

BRIEF DESCRIPTION OF THE DRAWINGS

These and/or other aspects will become apparent and more readily appreciated from the following description of example embodiments, taken in conjunction with the accompanying drawings of which.

DETAILED DESCRIPTION

Figure 1:
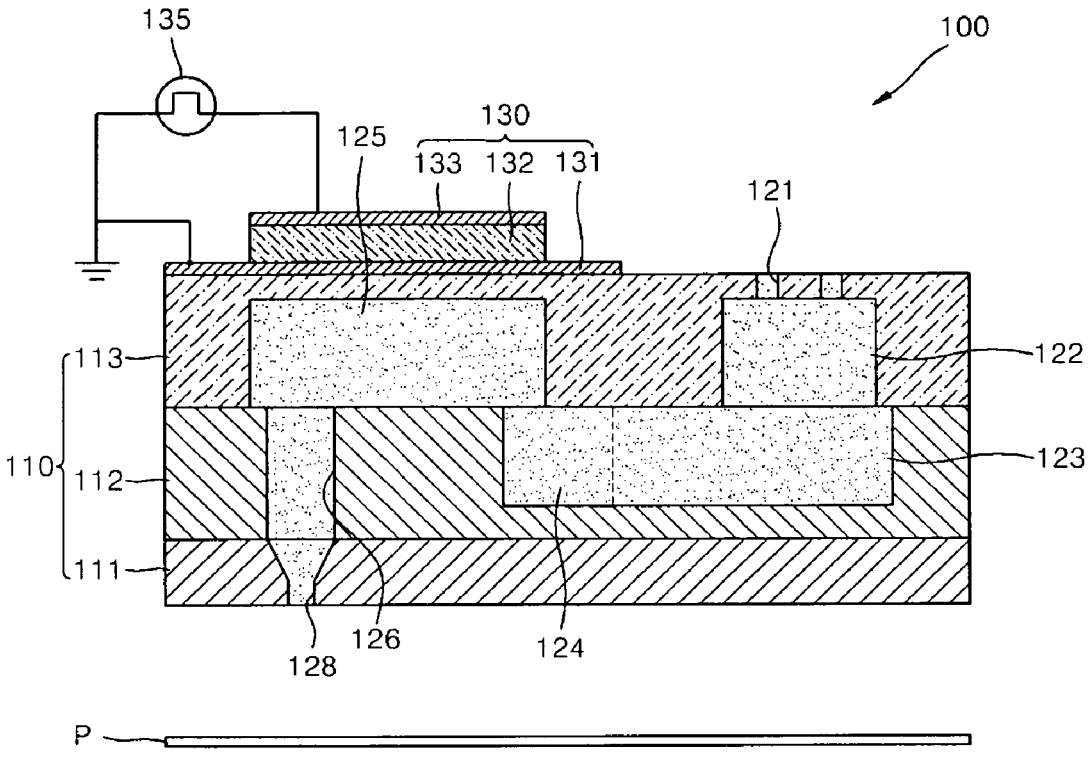
FIG. 1 is a cross-sectional view illustrating a piezoelectric inkjet printing apparatus according to example embodiments.

Example embodiments will now be described more fully with reference to the accompanying drawings, in which example embodiments are shown. The invention may, however, be embodied in different forms and should not be construed as limited to the embodiments set forth herein. Rather, these embodiments are provided so that this disclosure will be thorough and complete, and will fully convey the scope of the invention to those skilled in the art. In the drawings, the sizes of components may be exaggerated for clarity.

It will be understood that when an element or layer is referred to as being "on", "connected to", or "coupled to" another element or layer, it can be directly on, connected to, or coupled to the other element or layer or intervening elements or layers that may be present. In contrast, when an element is referred to as being "directly on", "directly connected to", or "directly coupled to" another element or layer, there are no intervening elements or layers present. As used herein, the term "and/or" includes any and all combinations of one or more of the associated listed items.

It will be understood that, although the terms first, second, etc. may be used herein to describe various elements, components, regions, layers, and/or sections, these elements, components, regions, layers, and/or sections should not be limited by these terms. These terms are only used to distinguish one element, component, region, layer, and/or section from another element, component, region, layer, and/or section. Thus, a first element, component, region, layer, or section discussed below could be termed a second element, component, region, layer, or section without departing from the teachings of example embodiments.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

Embodiments described herein will refer to plan views and/or cross-sectional views by way of ideal schematic views. Accordingly, the views may be modified depending on manufacturing technologies and/or tolerances. Therefore, example embodiments are not limited to those shown in the views, but include modifications in configuration formed on the basis of manufacturing processes. Therefore, regions exemplified in figures have schematic properties and shapes of regions shown in figures exemplify specific shapes or regions of elements, and do not limit example embodiments.

Reference will now be made in detail to example embodiments which are illustrated in the accompanying drawings, wherein like reference numerals refer to like elements throughout. In this regard, example embodiments may have different forms and should not be construed as being limited to the descriptions set forth herein. Accordingly, example embodiments are merely described below, by referring to the figures, to explain aspects of the disclosure.

FIG. 1 is a cross-sectional view illustrating a piezoelectric inkjet printing apparatus according to example embodiments. Referring to FIG. 1, the inkjet printing apparatus includes an inkjet head 100 that ejects ink using a piezoelectric method. For example, the inkjet head 100 may eject ink droplets from a fixed position, onto a printing medium that moves. Also, the inkjet head 100 may eject ink droplets onto a printing medium P positioned at a fixed position while the inkjet head 100 is being moved. Alternatively, while the printing medium P is being moved, the inkjet head 100 may eject ink droplets while the inkjet head 100 moves in a direction perpendicular to a movement direction of the printing medium P. To this end, although not shown in FIG. 1, the inkjet printing apparatus may further include a movement unit for moving the inkjet head 100 and/or the printing medium P.

The inkjet head 100 includes a flow path plate 110 in which an ink flow path is formed and a piezoelectric actuator 130 that provides a driving force for ink ejection.

In detail, an ink flow path is formed in the flow path plate 110. The ink flow path may include an ink inlet 121 through which ink flows in, a plurality of pressure chambers 125 accommodating the ink that has flowed in, and a plurality of nozzles 128 for ejecting ink droplets. The ink inlet 121 may be formed in an upper portion of the flow path plate 110 and may be connected to an ink tank (not shown). Ink may be supplied from the ink tank to the inkjet head 100 via the ink inlet 121 and the ink may flow into the flow path plate 110 through the ink inlet 121. The plurality of pressure chambers 125 may be formed inside the flow path plate 110, and the ink that has flowed through the ink inlet 121 may be stored in the pressure chambers 125. In the flow path plate 110, manifolds 122 and 123 and a restrictor 124 may be formed to connect the ink inlet 121 to the plurality of pressure chambers 125. The plurality of nozzles 128 may be respectively connected to the plurality of pressure chambers 125. Ink filled in the plurality of pressure chambers 125 may be ejected in the form of droplets through the plurality of nozzles 128. The plurality of nozzles 128 may be formed at a bottom surface of the flow path plate 110 and in one row or two or more rows. In the flow path plate 110, a plurality of dampers 126 that respectively connect the plurality of pressure chambers 125 to the plurality of nozzles 128 may be formed.

The flow path plate 110 may be formed of a substrate of a material that is easy to minutely process, for example, a silicon substrate. For example, the flow path plate 110 may be formed by bonding three substrates, a first substrate 111, a second substrate 112, and a third substrate 113, by using a silicon direct bonding (SDB) method. In example embodiments, the ink inlet 121 may be formed to pass through an uppermost substrate, that is, the third substrate 113, and the plurality of pressure chambers 125 may be formed in the third substrate 113 from a bottom surface thereof to have a depth that may or may not be predetermined. The plurality of nozzles 128 may be formed to pass through a lowermost substrate, that is, the first substrate 111. The manifolds 122 and 123 may be formed in the third substrate 113 and the second substrate 112 in the middle, respectively. The plurality of dampers 126 may be formed to pass through the second substrate 112.

In example embodiments, the flow path plate 110 may be formed of three substrates, the first through third substrates 111, 112, and 113 but are not limited thereto. The flow path plate 110 may be formed of one substrate or two or four substrates, and the ink flow path therein may also be arranged in various configurations.

The piezoelectric actuator 130 provides a driving force for ink ejection, that is, pressure variation in the plurality of pressure chambers 125. The piezoelectric actuator 130 may be disposed on a portion of the flow path plate 110 to correspond to the plurality of pressure chambers 125. The piezoelectric actuator 130 may include a bottom electrode 131, a piezoelectric layer 132, and a top electrode 133 that are sequentially stacked on the flow path plate 110. The bottom electrode 131 may function as a common electrode, and the top electrode 133 may function as a driving electrode that applies a voltage to the piezoelectric layer 132. To this end, a power source 135 may be connected to the bottom electrode 131 and the top electrode 133. The piezoelectric layer 132 is deformed as a voltage applied from the power source 135 is applied thereto, thereby deforming the third substrate 113 which is a top wall of the piezoelectric chamber 125. The piezoelectric layer 132 may be formed of a piezoelectric material, for example, lead zirconate titanate (PZT) ceramics.

Volume and position precision of ink droplets may be influenced by the manufacturing conditions of elements of the inkjet printing apparatus, for example, the piezoelectric actuator 130 and the nozzle 128. In other words, volumes and speed of inkjet droplets ejected from the nozzles 128 may vary according to the manufacturing conditions of the elements of the inkjet printing apparatus such as the plurality of piezoelectric actuators 130 and the plurality of nozzles 128. If the speed of the ink droplets ejected from the plurality of nozzles 128 is not uniform, positions of the ink droplets ejected on a printing medium P that is being moved in relation to the inkjet printing apparatus may not be uniform. In example embodiments, a printing quality of an example inkjet printing apparatus may be improved if the inkjet printing apparatus is configured so that the volumes of inkjet droplets ejected through the plurality of nozzles 128 is uniform and the inkjet droplets are accurately dropped on desired positions on the printing medium P.

Volumes and speed of ink droplets may be influenced by a waveform of a driving signal applied to the piezoelectric actuator 130, that is, a voltage and an application duration of the driving signal. For example, the volumes of ink droplets may be adjusted to be uniform by adjusting a voltage of a driving signal but if the application duration thereof is adjusted to obtain a uniform speed, the volumes of ink droplets are affected again, and thus the volumes of the ink droplets may again not be uniform. Also, when an application duration of the driving signal is adjusted to obtain uniform volumes of the ink droplets and then a voltage of a driving signal is adjusted to obtain a uniform speed of the ink droplets, the volumes of ink droplets may become non-uniform again due to a change in the voltage of the driving signal. Accordingly, it may be difficult to determine a waveform of a driving signal that enables both uniform volumes and uniform speed of ink droplets.

According to example methods of adjusting ink ejection characteristics of the inkjet printing apparatus of example embodiments, at least one of a voltage and an application duration of a driving signal is adjusted to adjust volumes of ink droplets to be uniform. Also, instead of adjusting a speed of ink droplets, an application starting time of the driving signal is adjusted such that inkjet droplets having uniform volumes reach a printing medium P at the same time. Hereinafter, a method of adjusting ink ejection characteristics of an inkjet printing apparatus according to example embodiments will be described.

Figure 2:
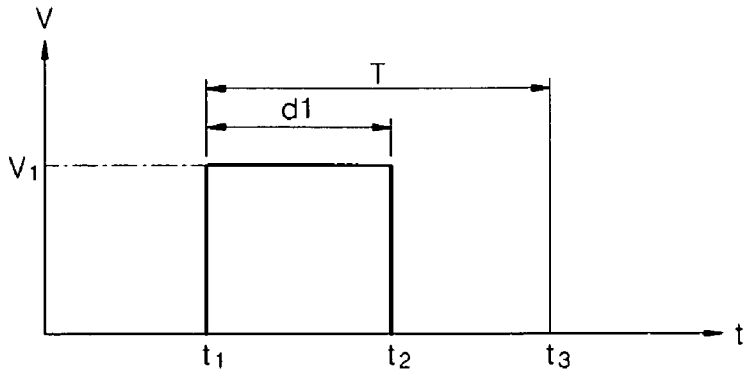
FIG. 2 illustrates a first driving signal, according to example embodiments.
Figure 3:
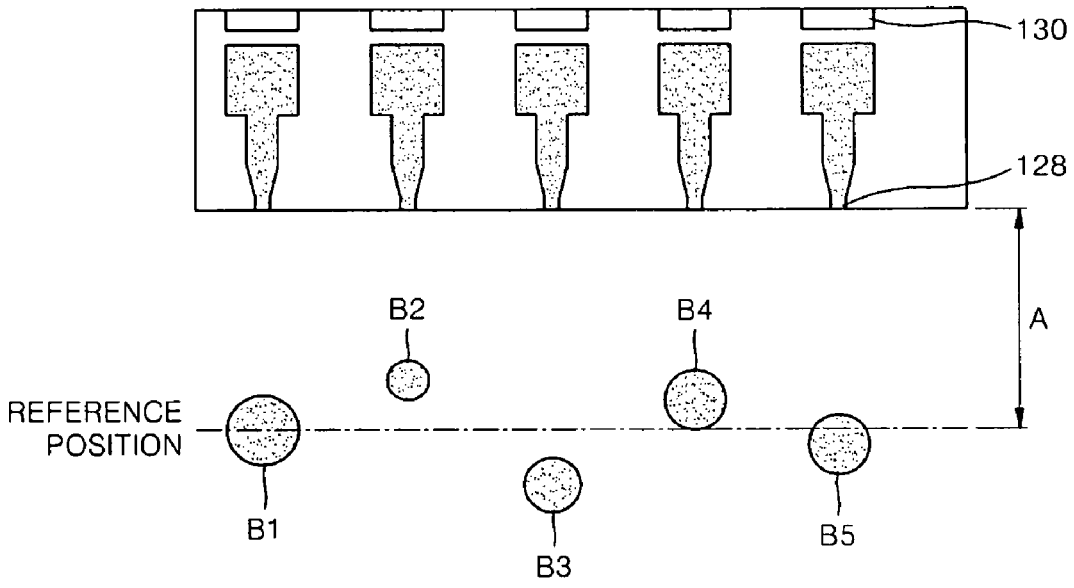
FIG. 3 illustrates a schematic view of ink droplets ejected according to the first driving signal illustrated in FIG. 2 after a reference time period

As illustrated in FIG. 2, a first driving signal of a voltage V1 and of an application duration d1=t2−t1 is applied to a plurality of piezoelectric actuators 130 at a time t1. Ink droplets ejected at a time t3 after a reference time period T may be photographed using a high speed camera. The reference time period T may be determined to correspond to a reference position at which a printing medium P is to be positioned. As illustrated in FIG. 3, ink droplets B1 through B5, not having uniform volumes and positions, may be obtained according to the ink ejection characteristics of the inkjet printing apparatus. The volumes of the ink droplets B1 through B5 may be calculated by measuring diameters of ink droplets from photographed images and assuming the form of the ink droplets B1 through B5 to be spherical.

Figure 4:
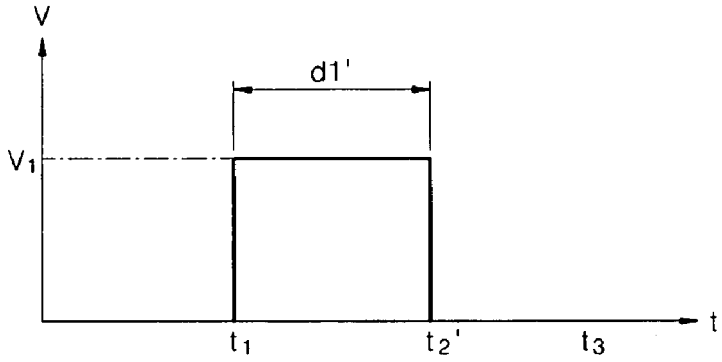
FIG. 4 illustrates a second driving signal whose application continuation time is adjusted for uniform volume of ink, according to example embodiments.
Figure 5:
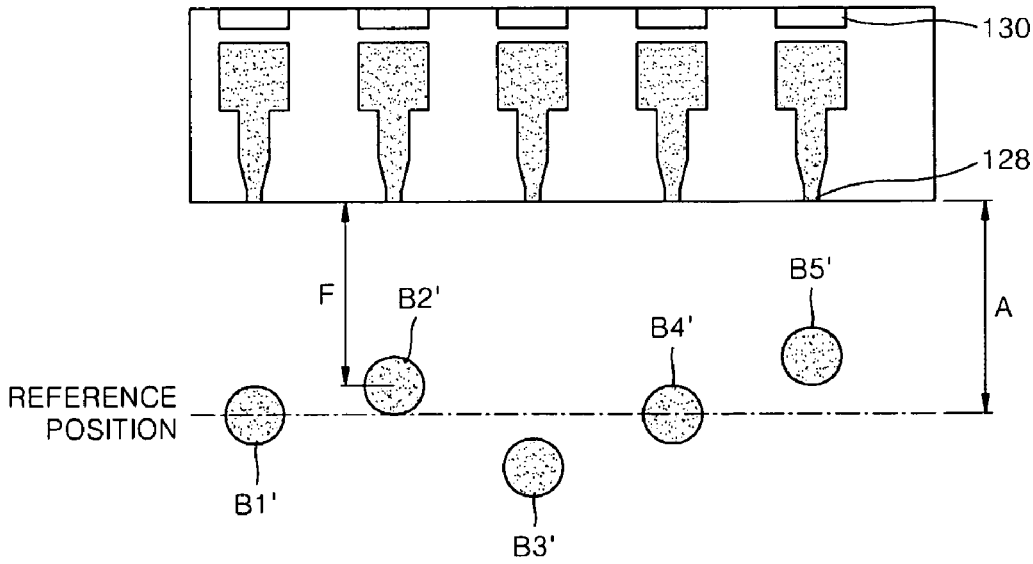
FIG. 5 illustrates a schematic view of ink droplets ejected according to the second driving signal illustrated in FIG. 4 after a reference time period.

Considering the volumes of the obtained ink droplets B1 through B5, an application duration for obtaining ink droplets of desired volumes with respect to the plurality of piezoelectric actuators 130 may be determined. Based on this, as illustrated in FIG. 4, a second driving signal having a voltage V1 and an application duration d1'(=t2'−t1) is applied to each of the plurality of piezoelectric actuators 130. As one skilled in the art would recognize, the parameter t2' may be different for each of the piezoelectric actuators of the plurality of piezoelectric actuators 130. The ejected ink droplets may be photographed again at a time t3 using a high speed camera. As illustrated in FIG. 5, ink droplets B1' through B5' having uniform volumes may be obtained. The above-described process may be repeated more than twice in order to obtain the ink droplets B1' through B5' having uniform volumes.

As the application duration of the second driving signal is different from that of the first driving signal, the positions of the ink droplets B1' through B5' at the time t3 may be different from that of the ink droplets B1 through B5 of FIG. 3. In example embodiments, an application starting time of the second driving signal may be determined such that the ink droplets B1' through B5' of FIG. 5 reach a reference position at the same time at the time t3. In FIG. 5, the ink droplet B1' is positioned almost at a reference position at the time t3, and thus if the second driving signal is applied at the time t1, the ink droplet B1' may be exactly deposited at a desired position on a printing medium. However, since the ink droplet B2' has not reached the reference position at the time t3, the ink droplet B2' may reach the reference position at a point of time 't3+offset time'. Here, as the printing medium P moves a distance corresponding to a formula 'offset time×movement speed' during the offset time, the ink droplet B2' is deposited at an offset position on the printing medium P by the distance corresponding 'offset time×movement speed' from the desired position.

In order that the ink droplet B2' reaches the reference position at the time t3, the ink droplet B2' may be ejected at a point of time prior to the time t1 by the offset time. That is, the second driving signal may be applied to the piezoelectric actuator 130 at a point of time prior to the time t1 by the offset time. This offset time is referred to as a displacement amount of the application starting time of the second driving signal.

To calculate a displacement amount of the application starting time, movement distances of the ink droplets B1' through B5' in FIG. 5 are measured. When a distance from a reference position to the plurality of nozzles 128 is A, a reference time period is T, and the movement distances of the ink droplets B1' through B5' are F and a displacement amount of the application starting time is S, a formula $S=(A-F)/(F/T)=T\times(A-F)/F=T\times(A/F-1)$ is obtained.

Figure 6:
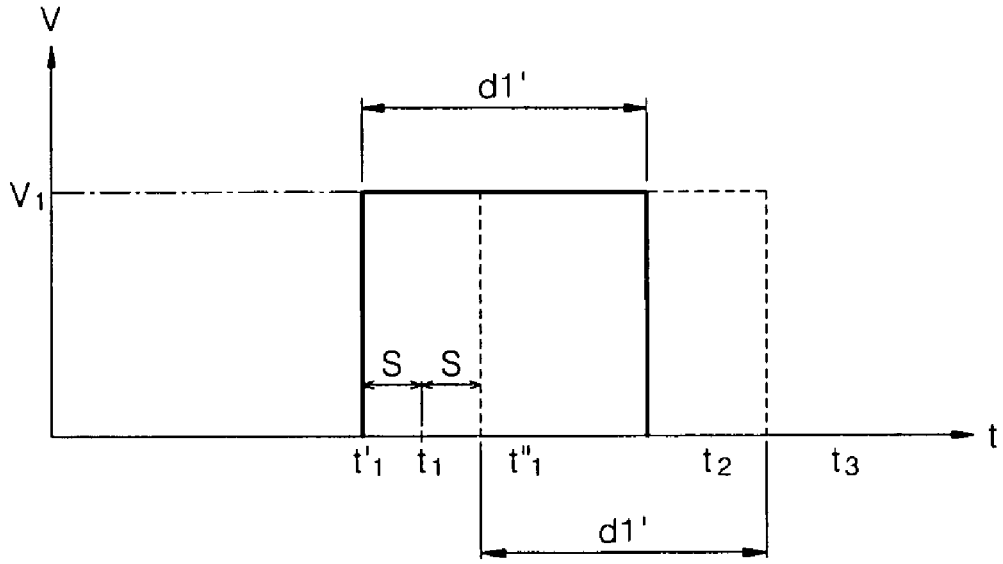
FIG. 6 is a timing diagram of the second driving signal illustrated in FIG. 4, illustrating a displaced application starting time of the second driving signal.

According to the above-described process and as illustrated in FIG. 6, a waveform of a driving signal applied to the plurality of piezoelectric actuators 130 is determined. If S is a positive number, a second driving signal is applied at a time t1', which is earlier than the time t1 by the displacement amount S. If S is a negative number, a second driving signal is applied at a time t1" when an absolute value S has passed beyond the time t1.

In order to adjust volumes of ink droplets to be uniform, a voltage of a driving signal may be controlled. For example, a driving waveform as illustrated in FIG. 2 may be applied to the plurality of piezoelectric actuators 130 at the same time, and then ejected ink droplets may be photographed at a time t3 after a reference time period T has passed using a high speed camera to thereby measure diameters of the ink droplets and calculate volumes of the ink droplets by assuming the shape of the ink droplets B1 through B5 to be spherical.

Figure 7:
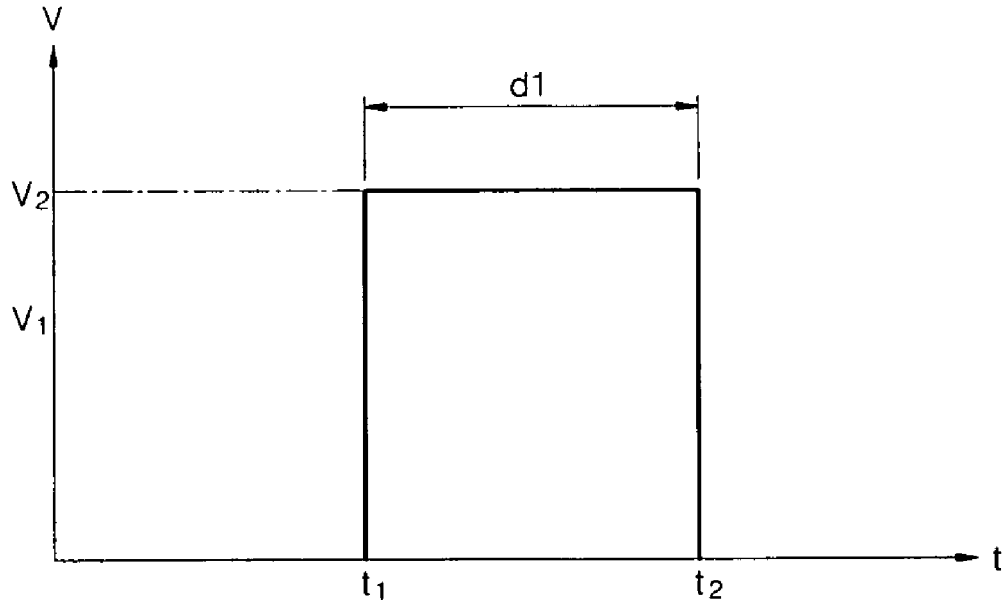
FIG. 7 illustrates a second driving signal whose voltage is adjusted for a uniform volume of ink, according to example embodiments.
Figure 8:
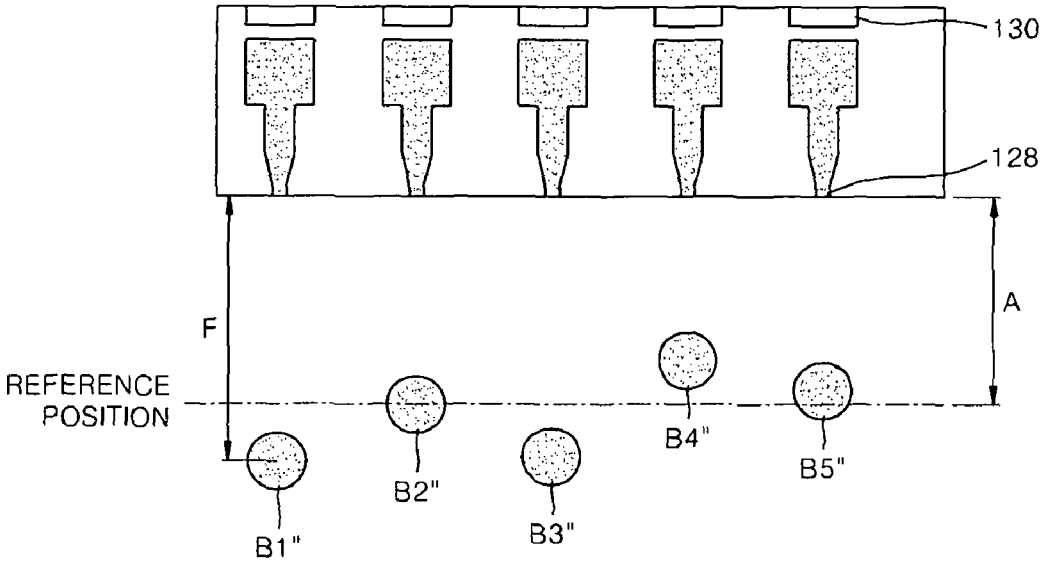
FIG. 8 illustrates a schematic view of ink droplets ejected according to the second driving signal illustrated in FIG. 7 after a reference time period.

Taking the calculated volumes of the ink droplets B1 through B5 into consideration, a voltage of a driving signal that is needed to obtain ink droplets of desired volumes with respect to each of the piezoelectric actuators 130 may be determined. Based on the voltage, a second driving signal having a voltage V2 and an application duration d1 as shown in FIG. 7 is applied to each of the plurality of piezoelectric actuators 130. As one skilled in the art would recognize, a the voltage V2 applied to each of the piezoelectric actuators may or may not be the same. The ejected ink droplets may be photographed again at the time t3 using a high speed camera. Then, as illustrated in FIG. 8, ink droplets B1" through B5" having uniform volumes may be obtained. In order to obtain the ink droplets B1" through B5" having uniform volumes, the above-described operation may be repeated twice or more.

In order to calculate a displacement amount of an application starting time, movement distances of the ink droplets B1" through B5" are measured from FIG. 8, and when a distance from a reference position to the plurality of nozzles 128 is A, a reference time period is T, and the movement distances of the ink droplets B1" through B5" are F and a displacement amount of the application starting time is S, a formula $S=(A-F)/(F/T)=T\times(A-F)/F=T\times(A/F-1)$ is obtained.

Figure 9:
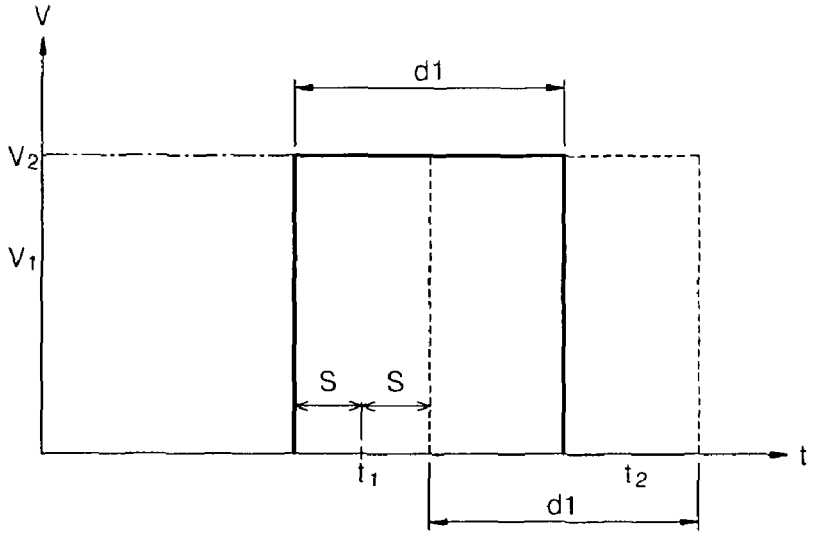
FIG. 9 is a timing diagram of the second driving signal illustrated in FIG. 7, illustrating a displaced application starting time of the second driving signal.

According to the above-described process and as illustrated in FIG. 9, a waveform of a driving signal applied to the plurality of piezoelectric actuators 130 may be determined.

To obtain uniform volumes of ink droplets ejected from the plurality of nozzles 128, an application duration and a voltage of the driving signal may be adjusted at the same time. The method of adjusting includes, as described above, measuring volumes of ejected ink droplets according to first driving signals that are applied to the plurality of piezoelectric actuators 130 at the same time, and determining a second driving signal according to which the ink droplets are adjusted to be uniform by repeating ink ejection and measurement of the volumes of the ink droplets while adjusting the voltage and application duration of the second driving signal. In order that the ink droplets ejected according to the second driving signal reach a printing medium P at the same time, an application starting time of a driving signal may be adjusted while reflecting a displacement amount (S) according to the above-described operation.

As described above, the volumes of the ink droplets ejected from the plurality of nozzles 128 may be adjusted to be uniform by adjusting application durations and/or voltages of driving signals respectively applied to the plurality of piezoelectric actuators 130, and after the uniform volumes of the ink droplets are obtained, an application starting time of a driving signal is adjusted with respect to each of the plurality of piezoelectric actuators 130 while reflecting a displacement amount S so that ink droplets ejected from the plurality of nozzles 128 may reach a printing medium P at the same time. Accordingly, the volumes of the ink droplets ejected from the plurality of nozzles 128 may be adjusted to be uniform, and the ink droplets of uniform volumes may be deposited at desired positions on the printing medium P. That is, the uniform volumes of the ink droplets and the uniform positions of the ink droplets may be obtained independently from each other, and thus differences in ink ejection characteristics for nozzles due to the processing errors of nozzles, the manufacturing dissimilarity of the piezoelectric actuators, or the like may be quickly corrected to thereby set optimum printing conditions.

Also, printing precision may be improved by the uniform volumes and uniform positions of the ink droplets, and thus the inkjet printing apparatus according to example embodiments may be applied to formation processes of minute structures of various fields such as flat panel display apparatuses, flexible display devices such as electronic paper (E-paper), printed electronics such as metal wiring, and organic thin film transistors (OTFTs).

Figure 10:
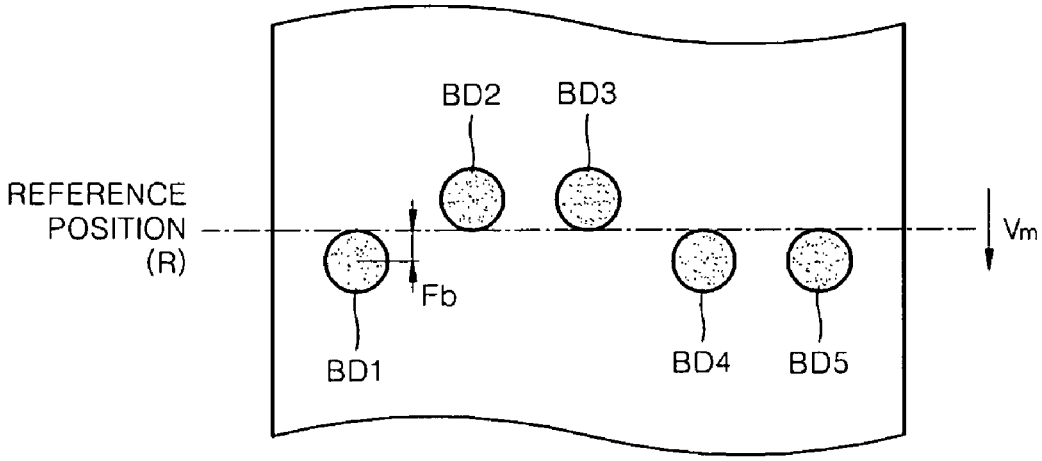
FIGS. 10 and 11 illustrate ink dots formed on a printing medium according to the first driving signal that adjusts volumes of the ink dots to be uniform, according to example embodiments.

After determining a waveform of the second driving signal with which volumes of ink droplets may be adjusted to be uniform by adjusting a voltage and/or application duration of the first driving signal, a displacement amount S of an application starting time of the second driving signal may also be calculated using the following method. First, a second driving signal is applied to eject ink onto a printing medium P which is being moved at a speed Vm that may or may not be predetermined, and the ejected ink is photographed using, for example, a camera. Then, as can be seen from FIG. 10, printing dots BD1 through BD5 of uniform size may be formed on a surface of the printing medium P. However, because the speed of the ink droplets ejected from the plurality of nozzles 128 may vary, positions of the printing dots BD1 through BD5 may not be uniform. The printing dots BD1 through BD5 may be aligned at reference positions R by adjusting an application starting time of the second driving signal by a time corresponding to offset amounts Fb of the printing dots BD1 through BD5 with respect to the reference positions R. The printing dots BD1, BD4, and BD5 indicate that the speeds of the ink droplets is high, and thus an application starting time of the second driving signal is to be delayed, and the printing dots BD2 and BD3 indicate that the speeds of the ink droplets are low, and thus the application starting time of the second driving signal is to be brought forward. That is, a time for the printing medium P to move by offset amounts Fb of the printing dot BD1 through BD5 is a displacement amount S of the application starting time of the second driving signal that is applied to each of the plurality of piezoelectric actuators 130. Thus, a formula S=Fb/Vm is obtained.

Figure 11:
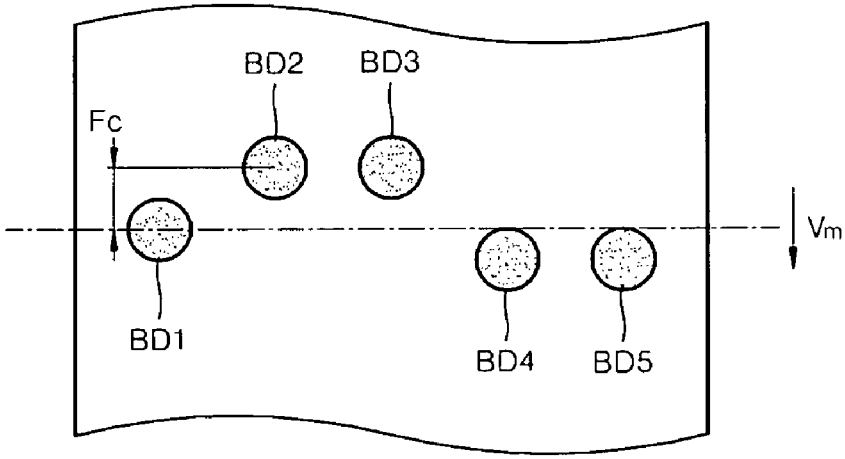

The displacement amount S of the application starting time of the second driving signal may be determined based on one of the printing dots BD1 through BD5. For example, as illustrated in FIG. 11, relative offset amounts Fc of the printing dots BD2 through BD5 is detected based on the printing dot BD1, and the displacement amount S of an application starting time of the second driving signal may be calculated from the relationship of S=Fc/Vm. Also, based on the second driving signal that is applied to one piezoelectric actuator corresponding to the printing dot BD1 among the plurality of piezoelectric actuators 130, an application starting time of the second driving signal to the piezoelectric actuators 130 corresponding to the printing dots BD2 through BD5 is brought forward or delayed, thereby aligning the printing dots BD2 through BD5 with the printing dot BD1.

The voltage, the application duration, and the displacement amount S of the application starting time of the driving signal with respect to the piezoelectric actuators 130 that are determined using the above-described process may be stored in, for example, a memory (not shown) as ejection characteristics information. When printing, the ejection characteristics information stored in the memory is read, and a waveform of a driving signal applied to each of the piezoelectric actuators 130 may be determined based on the ejection characteristics information, and by applying the determined driving signal to the piezoelectric actuators 130 according to the displacement amount S of the application starting time, a high quality printing image may be obtained.

The methods of adjusting ink ejection characteristics of an inkjet printing apparatus using a piezoelectric inkjet head and driving the inkjet printing apparatus are described above, but the methods may also be applied to a hybrid inkjet printing apparatus that uses both a piezoelectric method and an electrostatic method.

Figure 12:
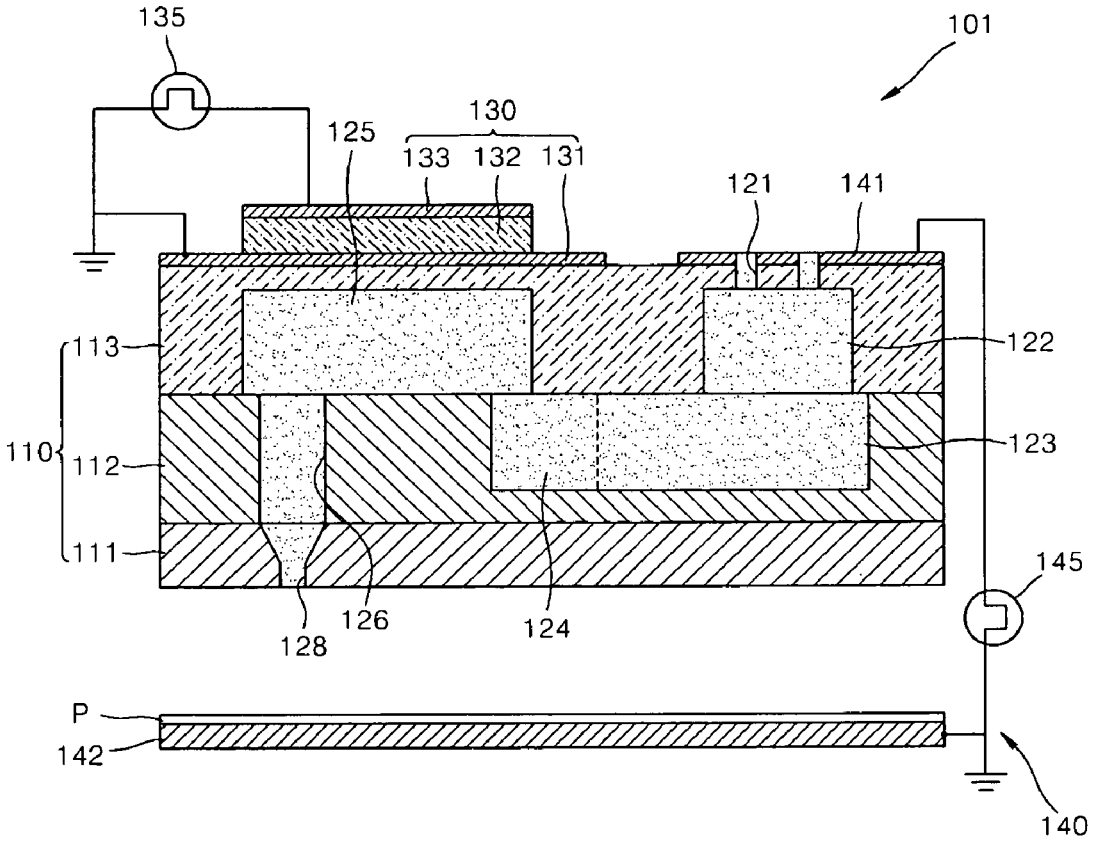
FIG. 12 illustrates a hybrid inkjet printing apparatus according to example embodiments.

Referring to FIG. 12, a hybrid inkjet head 101 is different from the piezoelectric inkjet head 100 of FIG. 1 in that the hybrid inkjet head 101 further includes an electrostatic force applying unit 140 that applies a second driving force for ink ejection, that is, an electrostatic force, to ink inside a nozzle 128. The electrostatic force applying unit 140 includes a first electrostatic electrode 141 and a second electrostatic electrode 142 facing each other, and a second power source 145 that applies a voltage between the first and second electrostatic electrodes 141 and 142.

The first electrostatic electrode 141 may be formed in a flow path plate 110. For example, the first electrostatic electrode 141 may be formed on the flow path plate 110, that is, on a third substrate 113. In example embodiments, the first electrostatic electrode 141 may be formed in an area where an ink inlet 121 is formed, so as to be separated from a bottom electrode 131 of a piezoelectric actuator 130. The second electrostatic electrode 142 may be separated from a lower surface of the flow path plate 110 by a distance that may or may not be predetermined, and a printing medium P may be disposed on the second electrostatic electrode 142.

Figure 13:
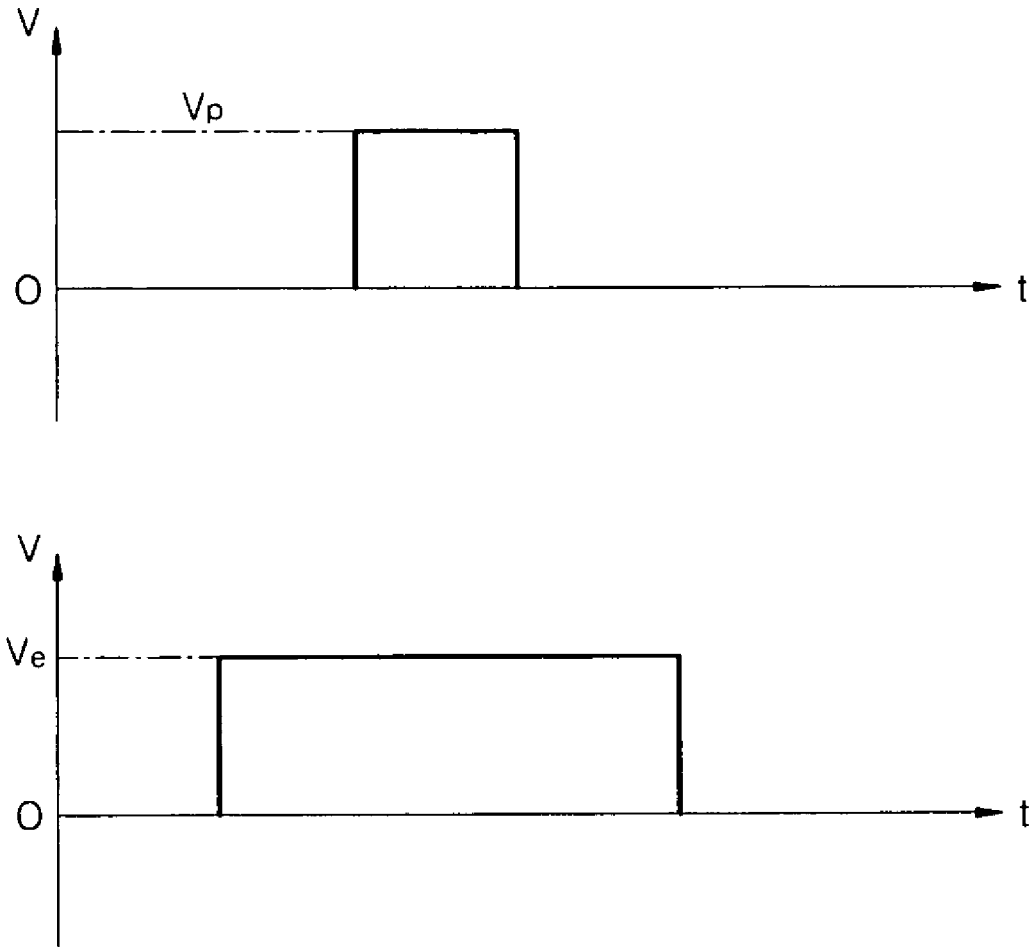
FIG. 13 illustrates a driving signal for driving the hybrid inkjet printing apparatus illustrated in FIG. 12, according to example embodiments.
Figure 14:
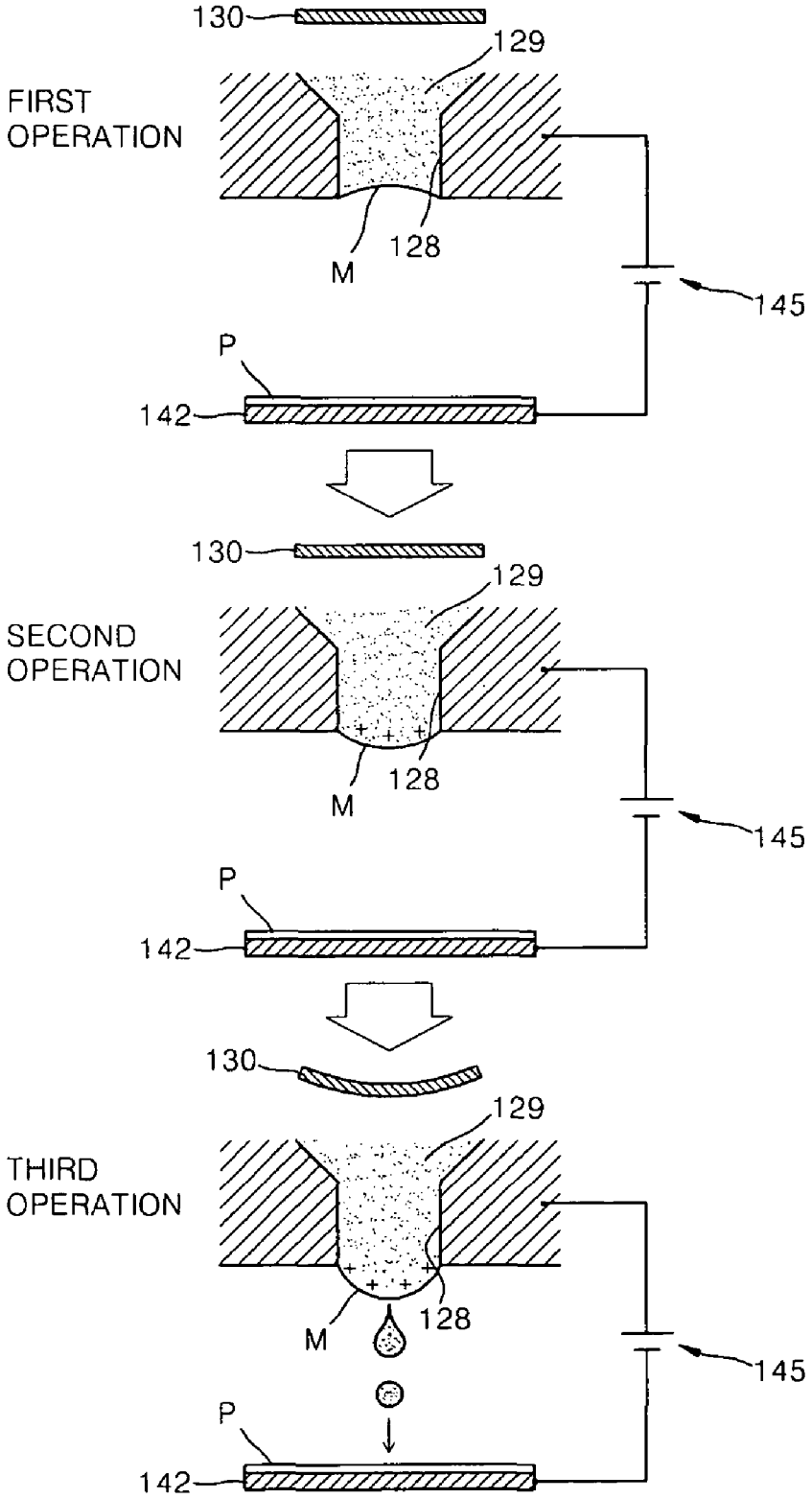
FIG. 14 illustrates an ink ejection process according to the driving signal illustrated in FIG. 13.

FIG. 13 illustrates a driving signal that is applied to a method of driving the inkjet printing apparatus illustrated in FIG. 12, according to example embodiments. FIG. 14 illustrates an ink ejection process according to the driving signal illustrated in FIG. 13.

Referring to FIGS. 13 and 14, a first operation indicates an initial state where no voltage is applied to the piezoelectric actuator 130 and the electrostatic force applying unit 140. Here, ink 129 in the nozzle 128 has a meniscus M that is slightly concave or flat due to surface tension.

In a second operation, an electrostatic driving voltage Ve is applied between the first electrostatic electrode 141 and the second electrostatic electrode 142 from the second power source 145. The electrostatic driving voltage Ve may be about 3 kV to about 5 kV. Accordingly, the electrostatic force is applied to the ink 129 in the nozzle 128 and a meniscus M of the ink 129 is deformed slightly convex. When the convex meniscus M is formed, an electric field is concentrated in a convex portion of the meniscus M, and thus positive charges in the ink 129 move toward the second electrostatic electrode 142 and are gathered at an end portion of the nozzle 128.

In a third operation, a driving voltage Vp may be applied to the piezoelectric actuator 130 for a period of time after application of the electrostatic driving voltage Ve so as to deform the piezoelectric actuator 130 such that a volume of the pressure chamber 125 is reduced. In example embodiments, the driving voltage Vp may or may not be predetermined. In addition, the period of time that the driving voltage Vp is applied may or may not be predetermined. The driving voltage Vp may be about 50 V to about 90 V. As described above, when a driving voltage Vp is applied while the electrostatic driving voltage Ve is being applied, the volume of the pressure chamber 125 is reduced and thus pressure therein increases. Accordingly, the meniscus M of the ink 129 in the nozzle 128 is deformed more convex, thereby forming a dome shape. Accordingly, a curvature radius of the meniscus M of the ink 129 is reduced, and more positive charges are focused on a convex tip of the meniscus M.

The electrostatic force is proportional to a charge amount and intensity of an electric field, and also, the charge amount is proportional to the intensity of the electric field. Accordingly, the electrostatic force is proportional to a square of the intensity of the electric field. Also, the intensity of the electric field is inversely proportional to the curvature radius of the meniscus M. Accordingly, the electrostatic force applied to the ink in a protruded portion from the end portion of the nozzle 128 is inversely proportional to a square of the curvature radius of the protruded portion of the meniscus M. Thus, the electrostatic force applied to the sharply protruded portion of the ink 129 increases, and accordingly, the curvature radius of the meniscus M in a center portion of the nozzle 128 is further reduced, and this further increases the electrostatic force. Finally, the sharply protruded portion of the ink 129 drops off the ink 129 that is inside the nozzle 128 and moves toward the second electrostatic electrode 142, thereby being printed on a printing medium P. Accordingly, relatively minute ink droplets may be ejected.

The driving voltage Vp applied to the piezoelectric actuator 130 may be removed, and after a period of time, the electrostatic driving voltage Ve applied between the first electrostatic electrode 141 and the second electrostatic electrode 142 may be removed. In example embodiments, the period of time before removing the electrostatic driving voltage Ve may or may not be predetermined. Accordingly, the piezoelectric actuator 130 may return to its original state, and the pressure in the pressure chamber 125 may also return to its original state, and thus the convex meniscus M may also return to its original state, that is, to the first operation.

As described above, according to example embodiments, the inkjet printing apparatus uses both piezoelectric and electrostatic ink ejection methods and thus ink may be ejected using a drop on demand (DOD) method in a piezoelectric method, it is relatively easy to control a printing operation, it is relatively easy to realize minute droplets using an electrostatic method, and directivity of ejected ink droplets may be improved. Therefore, the inkjet printing apparatus may be applicable in precision printing.

When the hybrid inkjet head 101 is used, the methods of adjusting ink ejection characteristics of the inkjet printing apparatus using the hybrid inkjet head 101 and driving the inkjet printing apparatus are similar to the methods applied to the piezoelectric inkjet head 100. However, a difference when using the hybrid inkjet head 101 is that an electrostatic driving voltage Ve may be applied between the first electrostatic electrode 141 and the second electrostatic electrode 142 while applying first and second driving voltages.

It should be understood that example embodiments described herein should be considered in a descriptive sense only and not for purposes of limitation. Descriptions of features or aspects within example embodiments should typically be considered as available for other similar features or aspects in other embodiments.

What is claimed is:

1. A method of adjusting ink ejection characteristics of an inkjet printing apparatus, the method comprising:

adjusting at least one of a voltage and an application duration of a driving signal applied to a plurality of piezoelectric actuators that provide ejection pressure to a plurality of nozzles so that volumes of a plurality of ink droplets ejected from the plurality of nozzles are uniform; and displacing an application starting time of the driving signal applied to the plurality of piezoelectric actuators so that the plurality of ink droplets ejected from the plurality of nozzles land on a printing medium at a same time.

2. The method of claim 1, wherein adjusting at least one of the voltage and the application duration of the driving signal, includes applying first driving signals having the same waveform to the plurality of piezoelectric actuators to eject a first plurality of ink droplets, detecting volumes of the first plurality of ejected ink droplets after a reference time period corresponding to a reference position, and determining second driving signals for the plurality of piezoelectric actuators by adjusting at least one of a voltage and an application duration of each of the first driving signals such that volumes of ejected ink droplets from the plurality of piezoelectric actuators are uniform.

3. The method of claim 2, wherein the reference position includes a location where the printing medium is disposed.

4. The method of claim 3, further comprising:

applying an electrostatic voltage to generate an electrostatic force to ink in the plurality of nozzles when applying the first and second driving signals.

5. The method of claim 2, wherein displacing the application starting time of the driving signal includes applying the plurality of the second driving signals to the plurality of piezoelectric actuators at the same time to eject a second plurality of droplets, determining movement distances of the second plurality of ink droplets after the reference time period, the movement distances being the distances between the second plurality of ink droplets to the plurality of nozzles, and determining a plurality of displacement amounts S of the application starting time as $S=T\times(A/F-1)$, where the movement distances of the second plurality of ink droplets are F, a distance from the reference position to the second plurality of nozzles is A, and the reference time period is T.

6. The method of claim 5, wherein the reference position includes a location where the printing medium is disposed.

7. The method of claim 6, further comprising:

applying an electrostatic force to ink in the plurality of nozzles when applying the first and second driving signals.

8. The method of claim 2, wherein displacing the application starting time of the driving signal includes applying the second driving signals to the plurality of piezoelectric actuators to eject a second plurality of ink droplets onto the printing medium that is being moved, determining a plurality of offset amounts of the second plurality of ink droplets from the reference position, the offset amounts being distances from the reference position to the second plurality of ink droplets, and determining a plurality of displacement amounts S of the application starting time as $S=Fb/Vm$, where the offset amount is Fb, and a movement speed of the printing medium is Vm.

9. The method of claim 2, wherein displacing the application starting time of the driving signal includes applying the second driving signals to the plurality of piezoelectric actuators to eject a second plurality of ink droplets on the printing medium that is being moved, determining, based on one of the ink droplets of the second plurality of ink droplets, offset amounts of the other ink droplets with respect to the one ink droplet, and determining a displacement amount S of the application starting time as $S=Fb/Vm$, where the offset amount is Fb, and a movement speed of the printing medium is Vm.

10. A method of driving an inkjet printing apparatus, the method comprising:

applying a first driving signal to a plurality of piezoelectric actuators to eject a first plurality of ink droplets onto a printing medium from a plurality of nozzles;

determining a plurality of second driving signals for the plurality of piezoelectric actuators by adjusting at least one of a voltage and an application duration of the first driving signal so that volumes of a second plurality of ink droplets having a uniform volume are ejected from the plurality of nozzles; and displacing application starting times of the plurality of second driving signals and applying the second driving signals with the displaced application starting time to the plurality of piezoelectric actuators so that the second plurality of ink droplets ejected from the plurality of nozzles reach a printing medium at the same time.

11. The method of claim 10, wherein an electrostatic voltage that applies an electrostatic force to ink in the plurality of nozzles is applied together with the driving signals.

* * * * *